US005844355A

United States Patent [19]

Wang et al.

[11] Patent Number: 5,844,355

[45] Date of Patent: Dec. 1, 1998

[54] COLOR CATHODE RAY TUBE AND METHOD FOR MANUFACTURING THE SAME DISPLAY SCREEN FOR COLOR

[75] Inventors: Ying-Fu Wang; Takashi Nishiguchi, both of Yokohama, Japan

[73] Assignee: Hitachi, Ltd., Tokyo, Japan

[21] Appl. No.: 676,341

[22] PCT Filed: Jan. 20, 1995

[86] PCT No.: PCT/JP95/00058

§ 371 Date: Jul. 19, 1996

§ 102(e) Date: Jul. 19, 1996

[87] PCT Pub. No.: WO95/20239

PCT Pub. Date: Jul. 27, 1995

[30] Foreign Application Priority Data

Jan. 21, 1994 [JP] Japan ..... 6-005102
Aug. 30, 1994 [JP] Japan ..... 6-205148

[51] Int. Cl.[6] ..... H01J 9/227; H01J 29/18; H01J 29/32

[52] U.S. Cl. ..... 313/461; 313/463; 396/546; 396/547; 430/23; 430/24

[58] Field of Search ..... 313/461, 463, 313/466, 402; 396/546, 547; 430/23, 24

[56] References Cited

U.S. PATENT DOCUMENTS 4,052,123 10/1977 Yamazaki et al. .
4,866,466 9/1989 Van Der Waal ..... 396/547

FOREIGN PATENT DOCUMENTS 0 294 867 A1 12/1988 European Pat. Off. .
0 415 286 A2 3/1991 European Pat. Off. .
4740983 10/1972 Japan .
62-154525 7/1987 Japan .

OTHER PUBLICATIONS

Kobayashi, "Electronic Display (CRT)", Electronic Information Communcations Society, Mar. 10, 1992.

*Primary Examiner*—Nimeshkumar Patel
*Attorney, Agent, or Firm*—Antonelli, Terry, Stout & Kraus, LLP

[57] ABSTRACT

A color cathode-ray tube having a good quality of display screen in which a fluorescent dot pattern is formed to have good configuration and positional accuracies. A method for manufacturing the display screen for the cathode-ray tube wherein a correction lens is formed with a plurality of fine adjacent planar or curved faces to cause uniform generation of a line width of latticed light/dark lines and a contrast thereof generated by level differences between the adjacent planar or curved faces when subjected to irradiation of exposure light all over a light exposure surface, the exposure light passed through the correction lens during vibration of the correction lens is directed through a shadow mask on a fluorescent film of an inner surface of a face panel of the cathode-ray tube for uniform irradiation thereof of the fluorescent film, the fluorescent dot pattern is formed on the inner surface of the face panel with the light-exposed fluorescent film used as a mask, whereby the fluorescent dot pattern having good configuration and positional accuracies is formed on the inner surface of the face panel, the display screen is formed with the fluorescent dot pattern having pixels of 1,000,000 or more and has a luminosity fluctuation factor of ±0.15% or less.

26 Claims, 21 Drawing Sheets

COLOR CATHODE RAY TUBE AND METHOD FOR MANUFACTURING THE SAME DISPLAY SCREEN FOR COLOR

TECHNICAL FIELD

The present invention relates to a color cathode-ray tube and a method for manufacturing the cathode-ray tube, and more particularly to a high quality of high-definition cathode-ray tube in which a correction lens for formation of a fluorescent dot pattern of the cathode-ray tube for use in a lithography or light exposure step of forming a fluorescent film of the color cathode-ray tube is improved to obtain a high quality of high-definition cathode-ray tube as well as also to a method for manufacturing the cathode-ray tube.

BACKGROUND ART

As a higher definition is demanded for a color cathode-ray tube, a higher accuracy has also been required in the light exposure step of subjecting a fluorescent screen to light exposure and development.

In formation of the fluorescent screen of a black matrix type color cathode-ray tube, a multiplicity of stripe- or dot-like holes are left to form a black body and a stripe- or dot-like fluorescent film is formed for the holes. To this end, the holes should coincide with the fluorescent film in their position, for which reason it becomes vital to accurately position the both with respect to the electronic beam irradiation position.

For the purpose of carrying out the above positioning (registration correction), various types of correction lenses have been used, one of which types have a continuous curved face and another of which have a discontinuous surface. Since the both types are used for the purpose of refracting a light exposure beam to approximate it to the actual orbit of the electronic beam, they have a highly complex surface configuration.

In the case of the color cathode-ray tube having the aforementioned stripe-like fluorescent film, since fluorescent film has a stripe shape elongated in its vertical direction, no color draft will take place even when the electronic beam for its luminescence is projected as deviated in the vertical direction. Accordingly, it is only required to correct a beam deviation to the horizontal direction, the lens design is highly flexible. However, since it is impossible to arrange the fluorescent screen with a high density, it is impossible to obtain a high resolution. For this reason, for a color cathode-ray tube for use in a computer terminal requiring a high resolution, a dot-like fluorescent film is employed.

Upon formation of the above dot-like fluorescent film for the above color cathode-ray tube, correction must be carried out simultaneously both in the horizontal and vertical directions, for which end such various correction lenses as to provide optimum correction have been used.

Explanation will be made by referring to the drawing in connection with a light exposure base having such a discontinuous correction lens built therein as disclosed, e.g., in JP-B-47-40983.

Shown in FIG. 8 is a structure of a light exposure base 84 in which a light source 81, a lens 82 and a correction lens 83 are incorporated, and on which a face panel 85 having a shadow mask 87 is mounted. The correction lens 83, which has a plan shape and cross-sectional shapes tilted in horizontal (X) and vertical (Y) directions, is made up of a plurality of square or rectangular blocks divided in the respective direction, as shown in FIG. 9, (*a*) to (*c*). An exposure beam emitted from the light source 81 is passed through the lens 82, refracted by the correction lens 83, and then reaches the inner surface of the face panel 85 through an aperture of the shadow mask 87 for light exposure of a photosensitive film 86. In this case, for the purpose of preventing a latticed dark line pattern of discontinuous boundary faces 83' from being transferred onto the photosensitive film 86, the correction lens 83 is vibrated in the two X and Y directions during the light exposure. However, since the influence of the latticed dark line pattern disables accurater dot formation. To suppress generation of various latticed dark line patterns, many methods have been suggested. One of such suggested methods is a correction lens as disclosed in, e.g., JP-A- 62-154525, which lens configuration will be explained below.

FIG. 10 is a cross-sectional view of a correction lens which can suppress a latticed dark line pattern to some extent. In this case, the effective surface of the correction lens is divided into a plurality of regions in such a manner that a region 103*a* has a thickness d1 in its center, a region 103*b* has a thickness d2 in its center, a region 103*c* has a thickness d3 in its center, a region 103*d* has a thickness d4 in its center, a region 103*e* has a thickness d5 in its center, and a region 103*f* has a thickness d6 in its center. And level differences 104*a*, 104*b*, 104*c*, 104*d* and 104*e* between the regions having the thicknesses d1, d2, d3, d4, d5 and d6 are set to be about 100 $\mu$m. The correction lens is designed so that the contrast and surface area of a latticed dark line pattern (striped dark line pattern) on the fluorescent screen are made small by making small the respective level differences.

Even when the above correction lens is used, however, the demand of obtaining a high-definition color cathode-ray tube has not been able to be satisfied.

FIG. 11 is a magnified cross-sectional view of a part of a conventional correction lens 33 (the central thicknesses of respective regions being shown as ignored). The conventional correction lens 33 has region boundaries 34*a* and 34*b* formed perpendicular to a reference plane 32. Therefore, as shown in FIG. 3, (*a*), light is emitted from a light source so that incident light obliquely directed into the region boundaries 34*a* and 34*b* of the correction lens 33 is subjected to secondary refraction. As a result, the light is locally converged or dispersed so that the quantity of exit light varies and thus dark lines having a width t depending on the height of the region boundaries are produced.

FIG. 12 is a perspective view of a mold for use in molding the above correction lens based on a prior art technique. A mold 121 for the correction lens has a plurality of desired divided regions (such as 123) corresponding to those of the correction lens to be mold, the regions having respective region boundaries (such as 124). The mold based on the prior art technique is of a so-called assembled type which comprises a combination of several hundreds of blocks corresponding to the above regions. Therefore, it is highly difficult to make small the surface areas of the divided regions of the correction lens or to make smaller the level differences of the region boundaries in order to meet the higher definition requirement.

When the light emitted from the light source is passed through the correction lens made by the mold 121 to provide light exposure to the photosensitive film of the inner surface of the face panel of the color cathode-ray tube, a latticed pattern of dark lines having irregular widths is produced on the photosensitive film due to the different heights of the level differences of the region boundaries on the correction lens, as already mentioned above in connection with FIG. 3, (*a*), with the result of irregular generation of dots on the fluorescent screen of the color cathode-ray tube. In other words, the quantity of light reaching the photosensitive film becomes irregular with a bad configuration accuracy of the fluorescent dot pattern and a deteriorated positional accuracy thereof. For this reason, it has been difficult to obtain a good quality of high-definition color cathode-ray tube.

DISCLOSURE OF INVENTION

In the above prior art, due to the different level differences of the region boundaries on the correction lens, exposure light passed through the correction lens and irradiated on the shadow mask causes generation of a latticed pattern of light and dark lines having non-uniform widths and contrast. In order to lessen or reduce the influences of the latticed light and dark line pattern, the central thickness of the lens is adjusted, or the correction lens is vibrated during the light exposure to cause the influences of the latticed light and dark line pattern to appear uniformly throughout the entire light exposure surface. However, when it is desired to obtain a high-definition color cathode-ray tube having a display screen of 1,000,000 or more pixels in place of the conventional color cathode-ray tube having the display screen of 400,000 pixels, it has been impossible for the prior art to sufficiently satisfy the need.

As mentioned above, in order to obtain a good quality of cathode-ray tube, a high positional accuracy is required for the fluorescent screen dots. However, it has been impossible to obtain such a high-accuracy correction lens as to satisfy the above need.

In order to solve the above problems in the prior art, it is therefore an object of the present invention to provide a high quality of high-definition cathode-ray tube which can eliminate the influences of a latticed light and dark line pattern generated by a correction lens during light exposure to form a fluorescent dot pattern with accurate shape and position, and also to provide a method for manufacturing the cathode-ray tube.

The above object is attained by making a correction lens having a plurality of planar or curved faces differently tilted with respect to incident exposure light to cause the width and contrast of a latticed light/dark line pattern generated through the correction lens to become uniform all over the entire light exposure surface, the light exposure being carried out during vibration of the correction lens.

The plurality of differently-tilted planar or curved faces formed on the correction lens of the invention are made more finely in dimensions when compared with those of the prior art correction lens, i.e., made to be half, ⅓ or less of the prior art dimensions. And the level differences of boundaries of the planar or curved faces are made as small as possible so that;

(1) the tilt of the faces of the level differences of the boundaries is made parallel to the exposure light entrance direction, or (2) the tilt of the faces of the level differences of the boundaries is made to be 120 degree or less with respect to the reference plane and to be constant with respect to the exposure light entrance direction, or (3) the tilt of the faces of the level differences of the boundaries is made to be 120 degrees or less with respect to the reference plane, and the faces of the level differences are formed with finely recessed and raised portions, or (4) the tilt of the faces of the level differences of the boundaries is made to be 120 degrees or less with respect to the reference plane, and portions of the exposure light exit side of the correction lens producing the latticed dark lines are formed therein with lines of grooves or raised ridges or scratches having a constant width, or ones of these (1) to (4) are suitably combined.

Since the width and contrast of the latticed light/dark line or dark line pattern generated by the correction lens are made constant all over the light exposure surface, when light exposure irradiation is carried out during vibration of the correction lens, the quantity of light irradiated on the light exposure surface in a constant light exposure time becomes constant throughout the entire light exposure surface. When the quantity of exposure light is made constant in this way, a good fluorescent film of dot pattern having good positional and configuration accuracies is formed on the face panel of the cathode-ray tube.

Now explanation will be made as to the width and contrast of the latticed light/dark line or dark line pattern generated by the correction lens in the order of the above (1) to (4).

(1) When the tilt of the faces of the level differences of the boundaries is made parallel to the exposure light entrance direction, the percentage of secondary refraction in the exposure light at the level difference face becomes small and regions having an effect on the light exit surface becomes small. This results in generation of a pattern of latticed light and dark lines having a narrow line width based on the exposure light passed through the correction lens and having a constant contrast.

(2) When the tilt of the faces of the level differences of the boundaries is made to be 120 degree or less with respect to the reference plane and to be constant with respect to the exposure light entrance direction, interference occurs in the exposure light directed onto the level difference faces and the vicinity thereof, the exposure light is dispersed over a relatively wide area, the quantity of exposure light emitted from the portions of the correction lens affected by the level difference faces is reduced, and the portions result in generation of a pattern of latticed dark lines having a constant width and a constant contrast.

(3) When the tilt of the faces of the level differences of the boundaries is made to be 120 degrees or less with respect to the reference plane, and the faces of the level differences are formed with finely recessed and raised portions, the light transmissivity of the level difference faces is made low, the quantity of exposure light exiting from the portions of the correction lens affected by the level difference faces is made smaller than that in the above case (2), and the portions result in generation of a pattern of latticed dark lines having a constant width and a constant contrast.

(4) When the tilt of the faces of the level differences of the boundaries is made to be 120 degrees or less with respect to the reference plane, and portions of the exposure light exit side of the correction lens producing the latticed dark lines are formed therein with lines of grooves or raised ridges or scratches having a constant width; the portions result in generation of a pattern of latticed dark lines having a constant width and a constant contrast.

In accordance with the present invention, since the line width and contrast of latticed light and dark lines generated by the correction lens having the plurality of fine planar or curved faces formed thereon are made constant and uniform all over the light exposure surface on the shadow mask, when light exposure is carried out during vibration of the correction lens, a fluorescent dot pattern having good configuration and positional accuracies can be formed and thus a cathode-ray tube having a good quality of display screen can be obtained.

Further, use of such cathode-ray tubes enables production of high-definition television sets and terminal monitors.

BEST MODE FOR CARRYING OUT THE INVENTION

The best modes for implementing the present invention will be explained with reference to the accompanying drawings.

Figure 1:
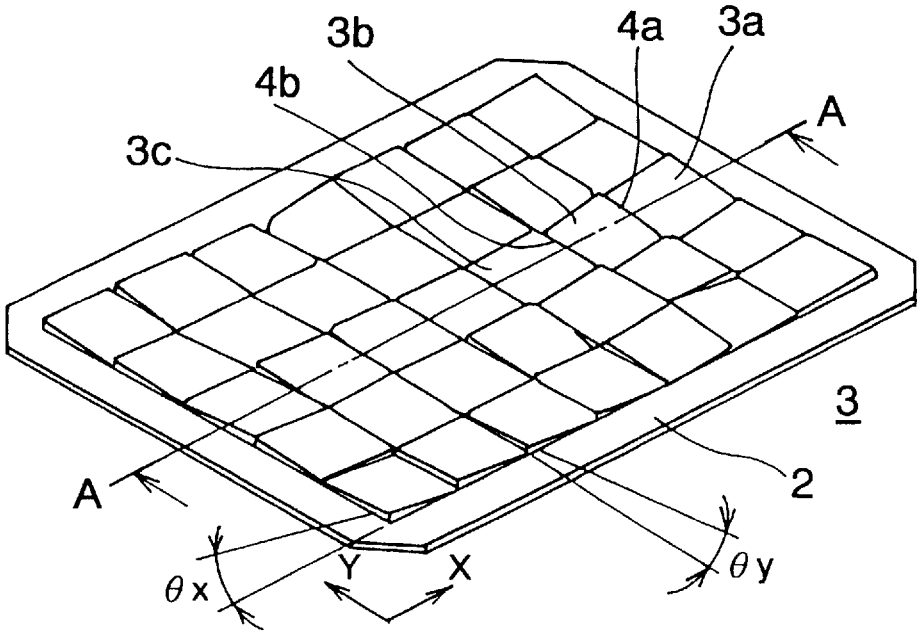
FIG. 1 is a perspective view of a correction lens in accordance with an embodiment 1 of the present invention, showing its appearance.
Figure 2:
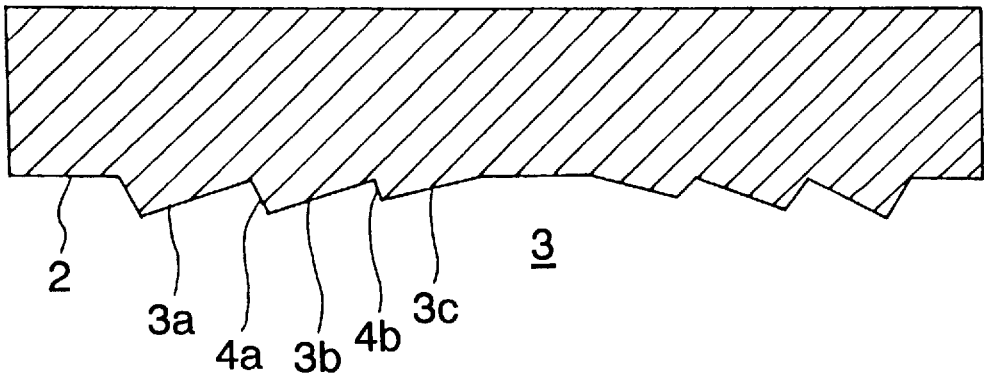
FIG. 2 is a cross-sectional view of the correction lens of the embodiment 1 of the present invention.

Embodiment 1:

FIG. 1 is a perspective view of an appearance of a correction lens in accordance with an embodiment of the present invention, and FIG. 2 is a cross-sectional view of the correction lens.

A correction lens 3, which is made of such optical plastic having a high light transmissivity as polymethyl metaacrylate, is provided on its reference surface 2 with a collection of a plurality of planar or curved faces 3*a* having different tilts with respect to X and Y directions of the reference surface 2.

Figure 9A:
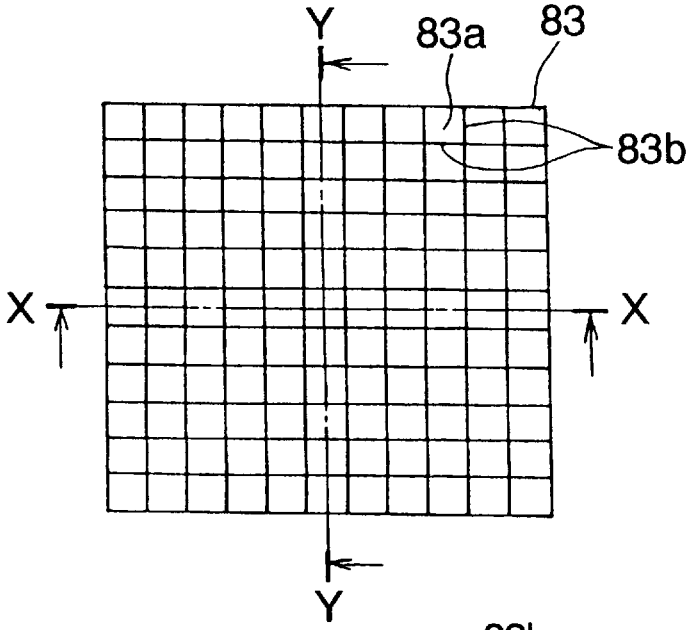
FIG. 9 shows plan and cross-sectional views of the prior art correction lens.
Figure 9C:
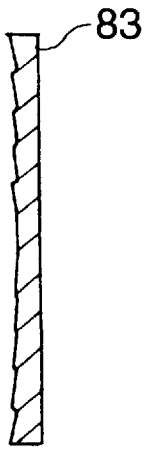
Figure 9B:
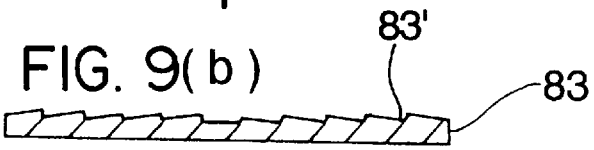
Figure 10A:
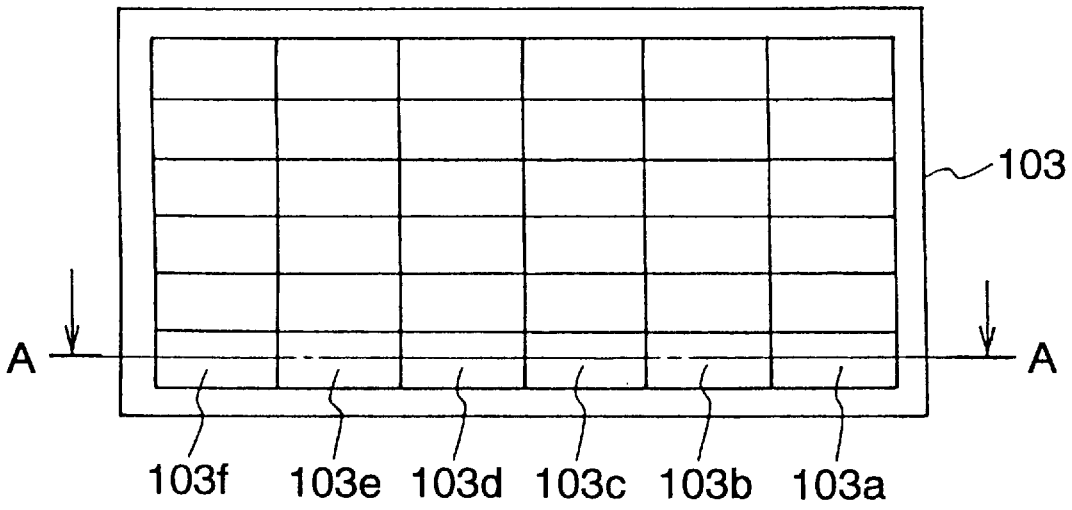
FIG. 10 shows plan and cross-sectional views of a prior art correction lens.
Figure 10B:
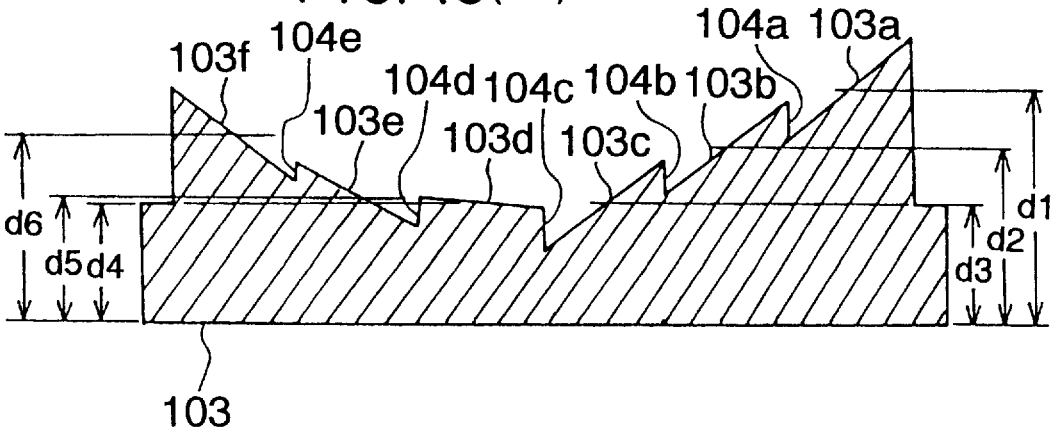
Figure 11:
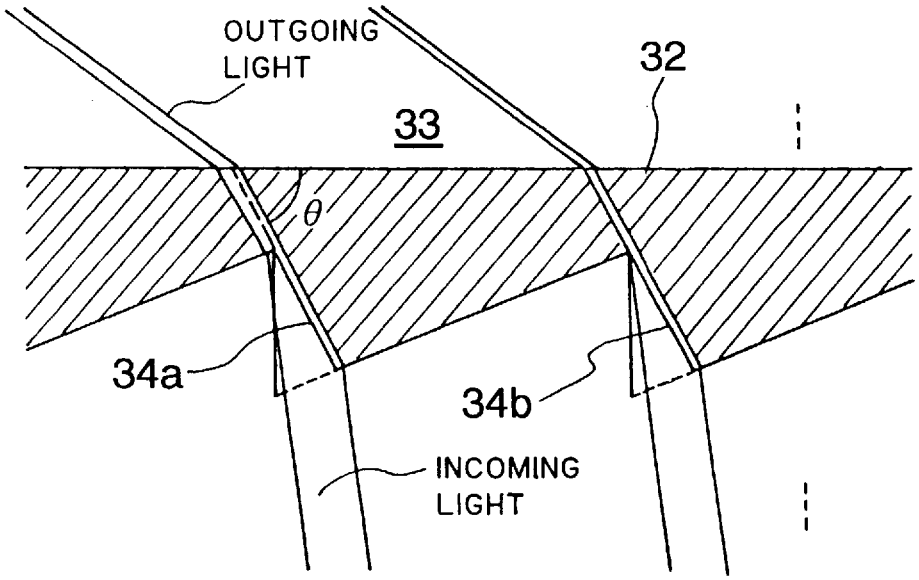
FIG. 11 is a magnified cross-sectional view of a part of a prior art correction lens.
Figure 12:
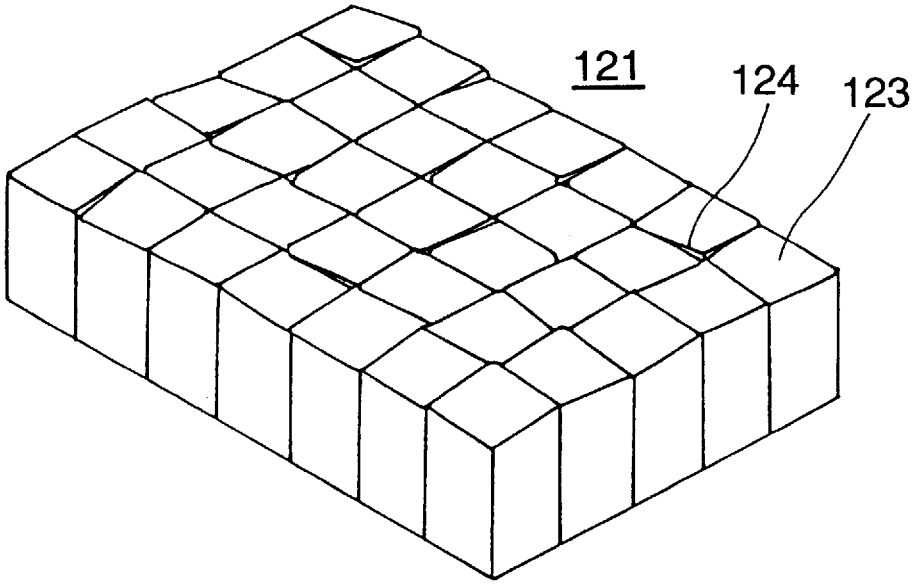
FIG. 12 is a perspective view of a mold for the prior art correction lens.

The correction lens of the present invention shown in FIG. 1 has a configuration similar to that of such a conventional correction lens manufactured by a prior art technique as shown in FIG. 9, but different from the prior art correction lens in that the prior art correction lens is manufactured by making the planar or curved faces with use of a mold assembly of respectively separate molds, whereas, the correction lens of the present invention is manufactured by making the planar or curved faces with use of a single mold having these planar or curved faces machined in its inner surface.

In this way, since the integral mold is used to mold the correction lens, the present invention can avoid the restrictions imposed on the prior art when a plurality of planar or curved faces 3*a* having different tilts are made in the correction lens 3 with use of the assembled type mold of the submolds having the minimum dimensions corresponding to the respective sides of the planar or curved faces. That is, in the present invention, the side dimensions of the planar or curved faces 3*a* can be made finely to be half, ⅓ or less of those made with use of the prior art assembled type mold.

Further, the planar or curved faces are positioned so that the value of biggest one of level differences at boundaries of the respective planar or curved faces having the different tilt angles becomes smallest, under which conditions the working conditions of the aforementioned integral correction lens are determined. As a result, the level differences at the boundaries, which have been 100 $\mu$m or so in the prior art correction lens made with use of the assembled type mold, can be made to be 5 $\mu$m or less.

Furthermore, in accordance with the present invention, since the integral mold for fabrication of the aforementioned correction lens is made by means of machining, level differences 4*a* at the boundaries of the lens faces can be made with a desired angle depending on the degree of generation of latticed light and dark lines by the level differences 4*a*.

This results in that the level differences at the discontinuous boundaries greatly affected by the light exposure effect due to the dot molding can be remarkably reduced, the influences of the effective surface of the planar or curved lens faces 3*a* on its area by the level differences 4*a* can be made small, the effective area can be made large with an increased design flexibility.

Figure 3A:
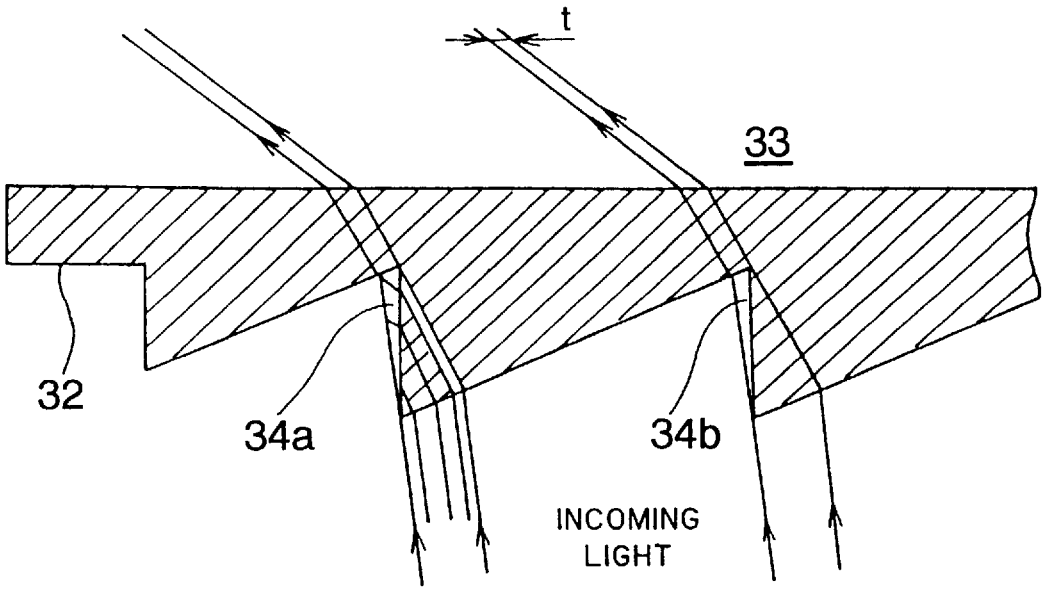
FIG. 3 shows magnified cross-sectional views of parts of a prior art correction lens and the correction lens of the embodiment 1 of the present invention respectively for comparison in light exposure effect therebetween.
Figure 3B:
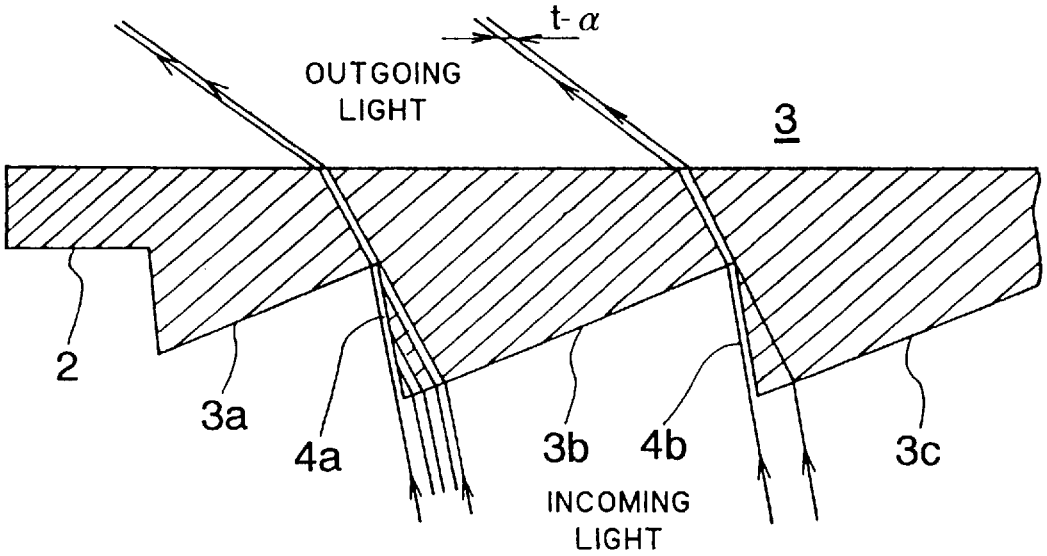

FIG. 3 shows magnified cross-sectional views of parts of a prior art correction lens and a correction lens of the present invention for comparison in light exposure effect therebetween.

A level difference 34*a* at boundaries of lens faces of the prior art correction lens is formed to be vertical to a reference plane 32 and the incident angle of exposure light directed onto the level difference 34*a* varies with its incident place. Thus, the secondary refraction of the incident light obliquely directed onto the level difference 34*a* causes the light to be locally converged or dispersed, which undesirably results in that the light quantity and width of the resultant latticed light and dark lines of the incident light will vary with its place (or will be distributed).

With the correction lens of the present invention, on the other hand, since the level difference 4*a* is made smaller than that of the prior art correction lens, i.e., to be 1/20 or less thereof; the light quantity and width of the resultant latticed light and dark lines generated by the exposure light transmitted through the correction lens of the present invention can be made substantially constant throughout the entire exposure surface.

FIG. 3, (*b*) is when the correction lens of the present invention is formed so that the tilt direction of the level difference 4*a* is parallel to the incident direction of the exposure light directed to the correction lens.

In this way, when the tilt direction of the level difference 4*a* is parallel to the incident direction of the exposure light directed to the correction lens, the secondary-refraction percentage of the incident light at the level difference faces can be lessened. As a result, the quantity of light of the latticed light and dark lines generated by the secondary refraction can be reduced substantially constant all over the light exposure surface and the width of the light and dark lines can also be made narrow or substantially constant all over the light exposure surface.

Explanation will next be made as to a mold for molding of the correction lens of the present invention.

Figure 13:
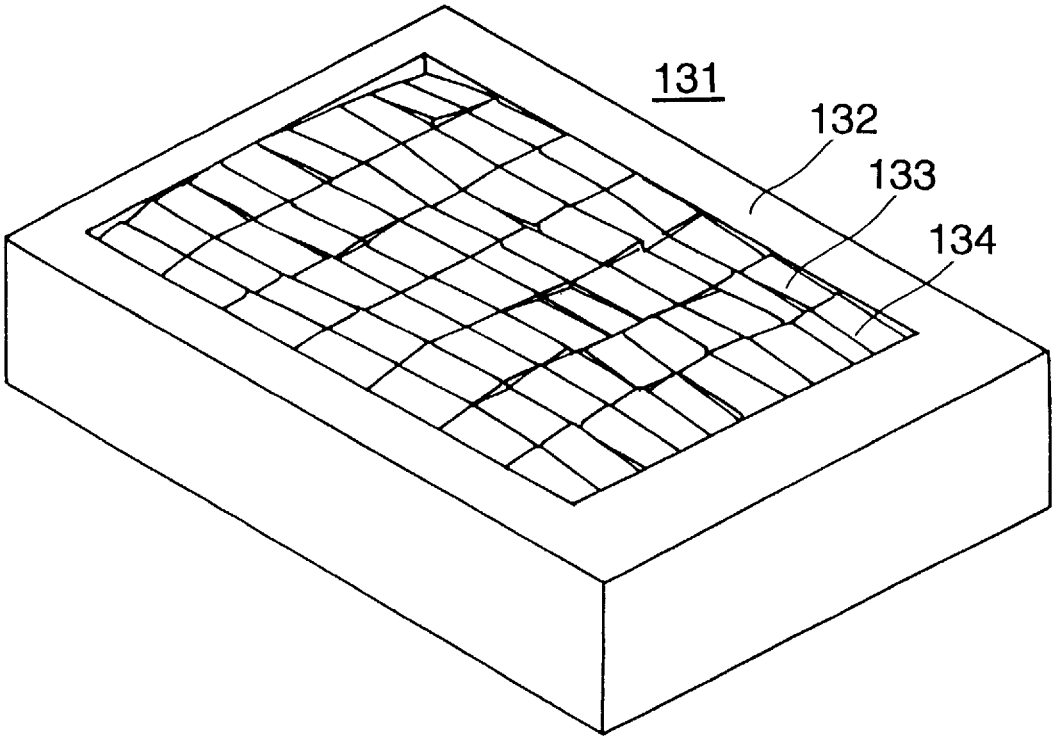
FIG. 13 is a perspective view of an appearance of a mold for the correction lens in accordance with the embodiment 1 of the present invention.

Shown in FIG. 13 is a perspective view showing an appearance of a mold for use in molding the correction lens of FIG. 1 in accordance with an embodiment of the present invention. In this connection, for the material of a mold 131, such non-ferrous soft metal as aluminum alloy, brass or copper is suitable from the viewpoint of its processability or machinability. The surface of the mold 131 is formed to correspond to the transfer surface of the correction lens shown in FIG. 1.

Explanation will then be made as to how to machine the mold.

Figure 14:
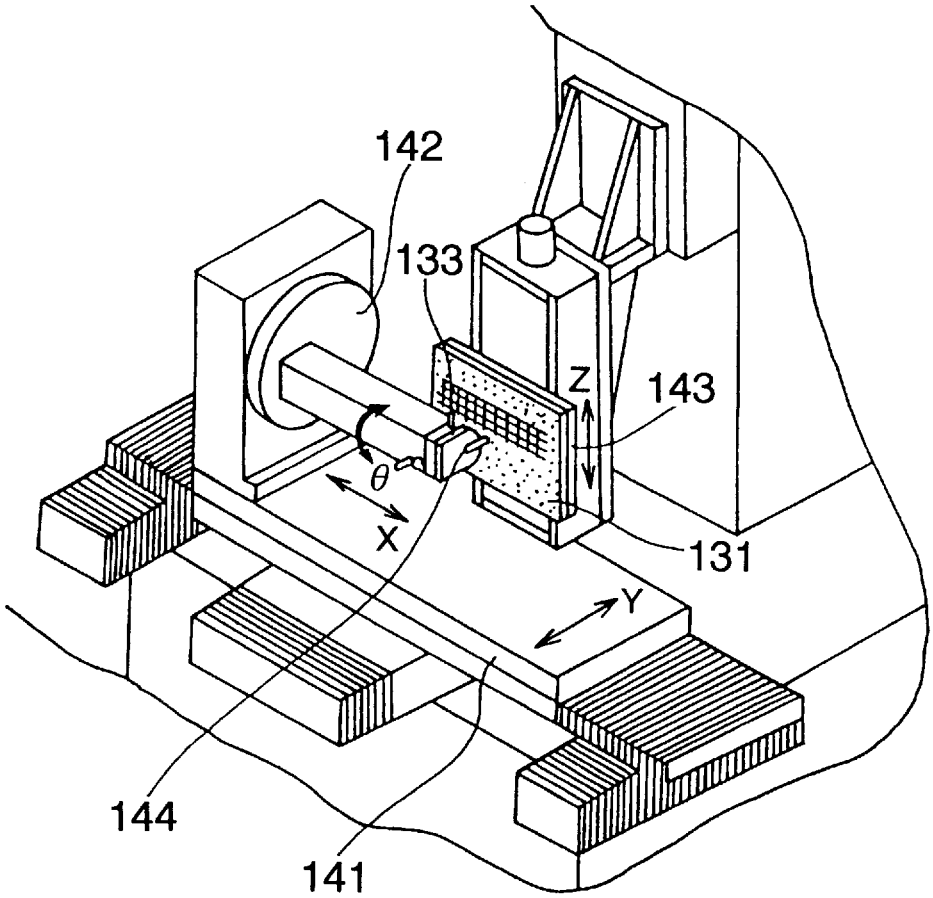
FIG. 14 is a machine for machining the mold of the correction lens in accordance with the embodiment 1 of the present invention.
Figure 15:
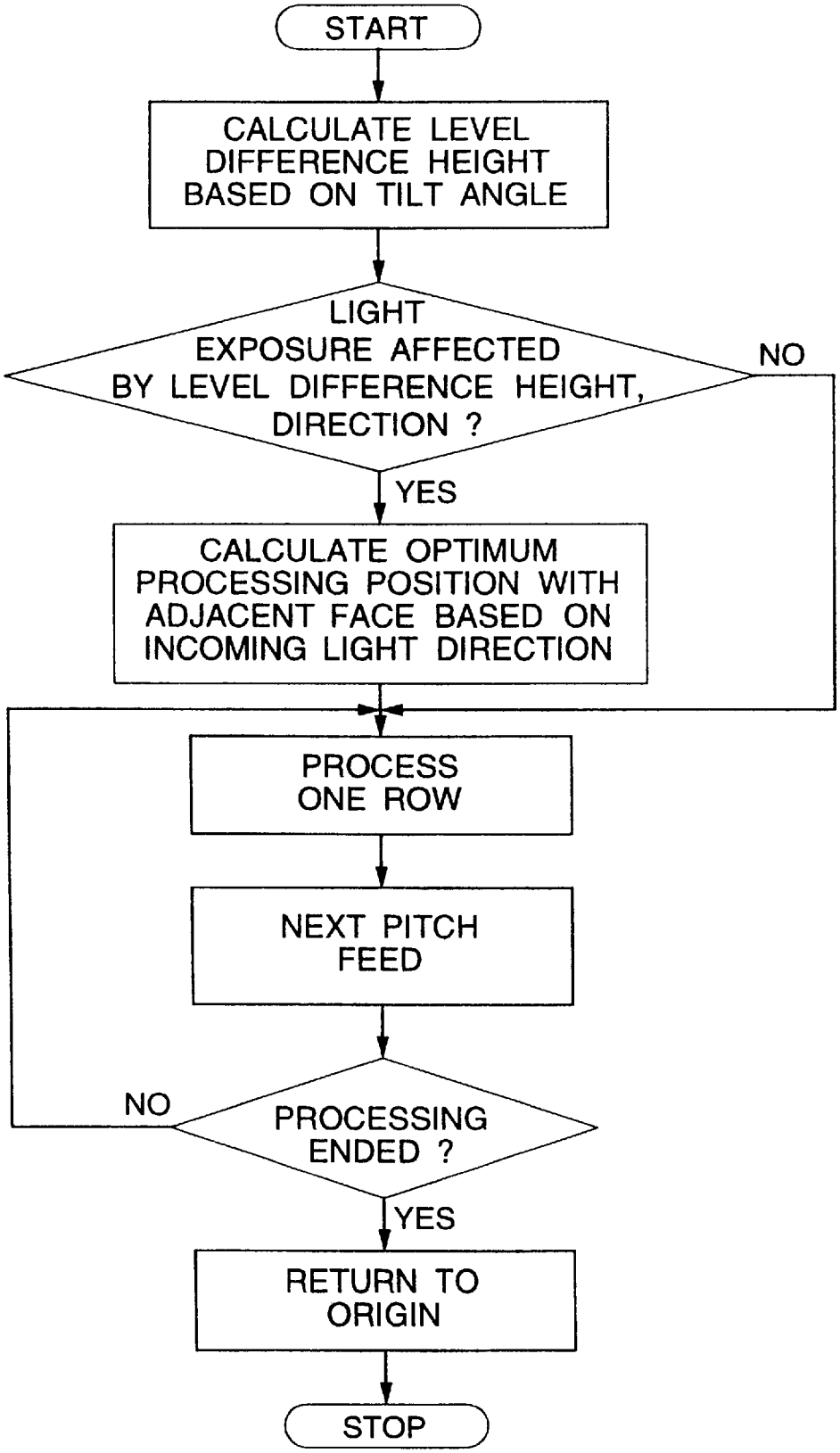
FIG. 15 is a flowchart for explaining a machining process for the mold of the correction lens in accordance with the embodiment 1 of the present invention.

FIG. 14 shows a machine for machining the mold for fabrication of the correction lens of the present invention, and FIG. 15 shows a flowchart for explaining the machining process of the mold of the present invention.

The mold 131 is secured onto a pitch-direction positioning table or Z table 143. The transfer surface having the aforementioned surface configuration of the correction lens is cut in the surface of the mold with use of such a cutting tool as a diamond cutting tool 144. The diamond cutting tool 144 is held to a rotary table 142 so that the center of a cutting edge at a tip end of the cutting tool rotates on the center of the rotary table as a rotary center, whereby a motion of a table 141 toward the mold 131 in a Y direction provides a cutting thereto and a continuous motion of the table 141 in an X direction provides a cutting feed.

Prior to the cutting operation, the height of the level difference 4*a* of the discontinuous boundaries is previously calculated on the basis of the tilt angle of the planar or curved faces 3*a* of the correction lens 3 of the present invention and the optimum configuration or shape of the correction lens 3 is previously determined so that the value of highest one of level differences becomes smallest. Further, the incident angle of light emitted from a light source is calculated to find a contact point tangent to the adjacent tilt face based on trigonometry, and the machining conditions are determined so that the value of maximum one of the level differences becomes smallest and the tilt direction of the side wall of corresponding one of the boundaries of the lens faces becomes parallel to the incident direction of the exposure light emitted from the light source. Such cycle is sequentially repeated until machining positions at the level differences at the discontinuous boundaries are all determined, after which the mold cutting is carried out.

Depending on the cutting feed position, each time the cutting of a single planar or curved face 133 is completed, the pitch feed of the Z table 143 is carried out so that the position or attitude of the diamond cutting tool 144 is sequentially changed by the rotary table 142 during the cutting operation to the desired Y-direction tilt angle of the planar or curved face 133 to be next machined. In this connection, the length of the cutting edge of the diamond cutting tool 144 perpendicular to the cutting direction X may correspond substantially to the length of one side of the desired planar or curved face 133 in the cutting width direction.

Explanation will then be made as to how to make the mold for the correction lens of the present invention by means of plastic working.

Figure 16:
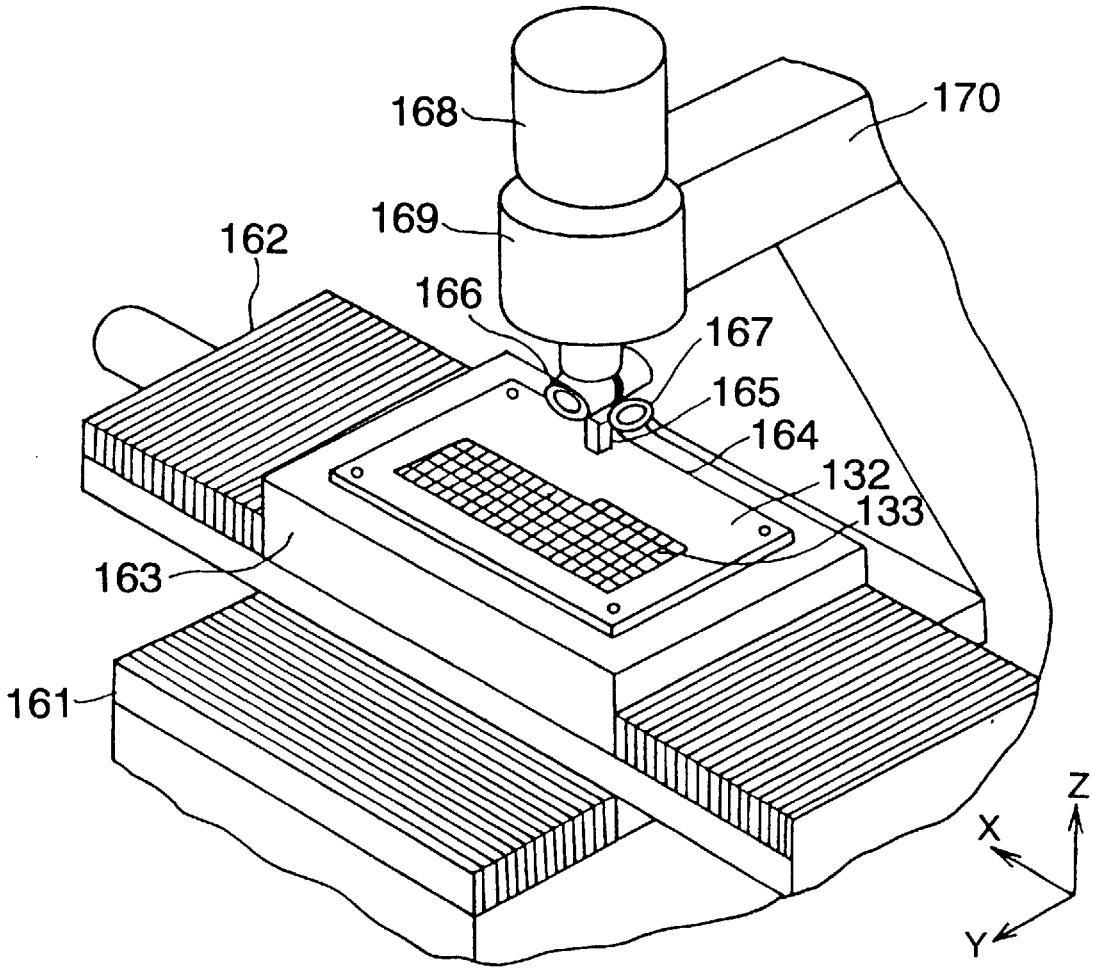
FIG. 16 a machine for plastic working of the mold of the correction lens in accordance with the embodiment 1 of the present invention.

Shown in FIG. 16 is a machine for plastic working a mold for a correction lens of the present invention. More specifically, a mold 164 is held on a positioning table 163 mounted movably in two axial directions of X and Y tables perpendicular to each other. A punch 165 for making on the surface of the mold a plurality of planar or curved faces 133 having different tilt angles with respect to a reference bottom surface 132 is fixedly mounted to goniostages 166 and 167 rotably on the surface to be worked by the punch. The goniostages are mounted to a lower end of a Z shaft 168 movable in the vertical direction. Also mounted to the lower end of the Z shaft 168 is a controller 169 which includes a force sensor for controlling and managing a depressing force of the punch 165 toward the working surface. The Z shaft 168 is carried by a column 170.

Next, a process for working the mold for the correction lens using the above machine will be explained.

Figure 17:
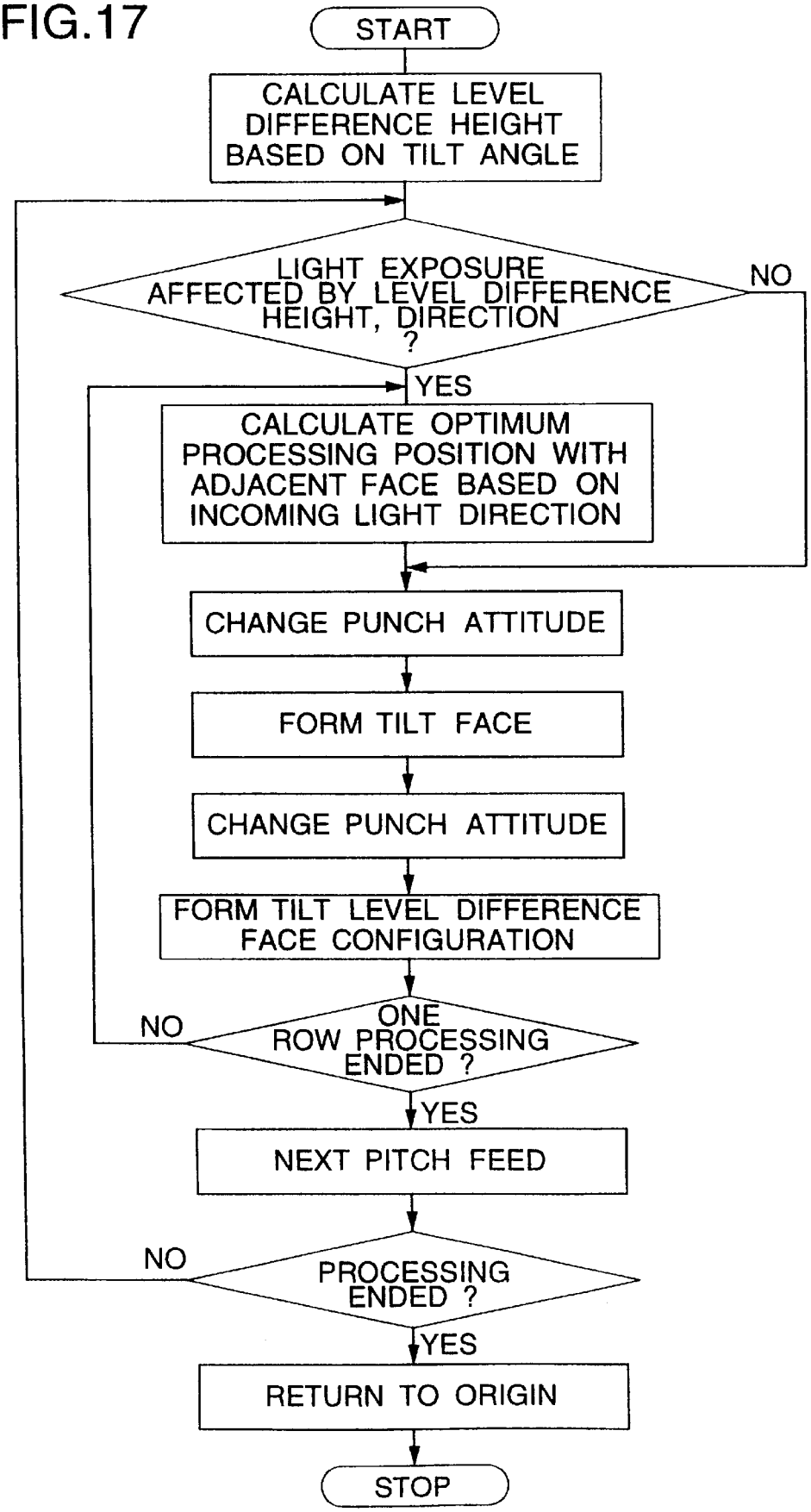
FIG. 17 is a flowchart for explaining a plastic working process for the mold of the correction lens in accordance with the embodiment 1 of the present invention.

FIG. 17 is a flowchart for explaining a process of plastic working a mold of the present invention. Prior to carrying out the mold machining, the height of a level difference 134 at the discontinuous boundaries is previously calculated on the basis of the tilt angle of the planar or curved face 133 to be machined to thereby determine such a machining position as to cause the level difference to be minimum. In the case where the configuration of the resultant correction lens is to cause easy generation of light and dark lines, the incident angle of light emitted from a light source is calculated to find a contact point tangent to the adjacent tilt face based on trigonometry, and the machining conditions are determined so that the level differences becomes smallest and the tilt direction of the side wall of the boundary of the corresponding lens face becomes parallel to the incident direction of the exposure light emitted from the light source. This cycle is repeated until the machining positions of the level differences at all the discontinuous boundaries are determined, after which the mold machining is started.

For the material of the punch 165, material having a high hardness such as diamond, CBN or carbide material is suitably employed. The surface configuration of a lower end of the punch contributing to the mold machining is previously made to correspond to the desired transfer configuration of the planar or curved face 133. The goniostage 166 in the X direction and the goniostage 167 in the Y direction are positioned by respective drive sources such as pulse motors so that the attitude or orientation of the punch 165 to the mold 164 coincides with the X- and Y-directional tilts with respect to the reference bottom surface 132 requested by the surface to be machined. Relative positioning of the punch and the mold 164 in an X-Y plane is carried out by driving the X and Y tables. After the relative positioning is completed, the Z shaft 168 holding the punch 165 thereon is lowered to depress the surface of the mold 164 to thereby form the desired planar or curved face 133 while the controller 169 including a force sensor controls and manages the depressing force, after which the attitude of the punch 165 is changed to form the level difference configuration of the lens face boundary. This cycle is sequentially repeated to machine the mold.

The aforementioned machining is based on the plastic machining to form the mold for the correction lens of the present invention.

After either one of the above plastic machining or cutting is used to obtain the final mold, the mold is supplied with optical plastic having a high light transmissivity such as polymethyl metaacrylate as mentioned earlier, or thermosetting resin, and then heated and compressed to mold a resultant correction lens. In this connection, ultraviolet-ray setting resin may be supplied onto the surface of the mold and ultraviolet ray may be irradiated thereon to form the resultant correction lens.

With the molds fabricated through such two types of working processes of the plastic working and cutting as mentioned above, since the size of the desired planar or curved face 133 and the surface configuration of the mold can be freely designed, a precise correction lens can be manufactured, leading to an improved pattern accuracy of the phosphor film, with the result that a cathode-ray tube can be subjected to accurate light exposure.

The above mold may be made not only by the aforementioned plastic working or cutting but also by electro-discharge machining.

Explanation will next be made as to how the correction lens of the present invention molded by the aforementioned working technique is used to subject the photosensitive film on the inner surface of a face panel of a cathode-ray tube to light exposure to form a phosphor-material dot pattern.

Figure 8:
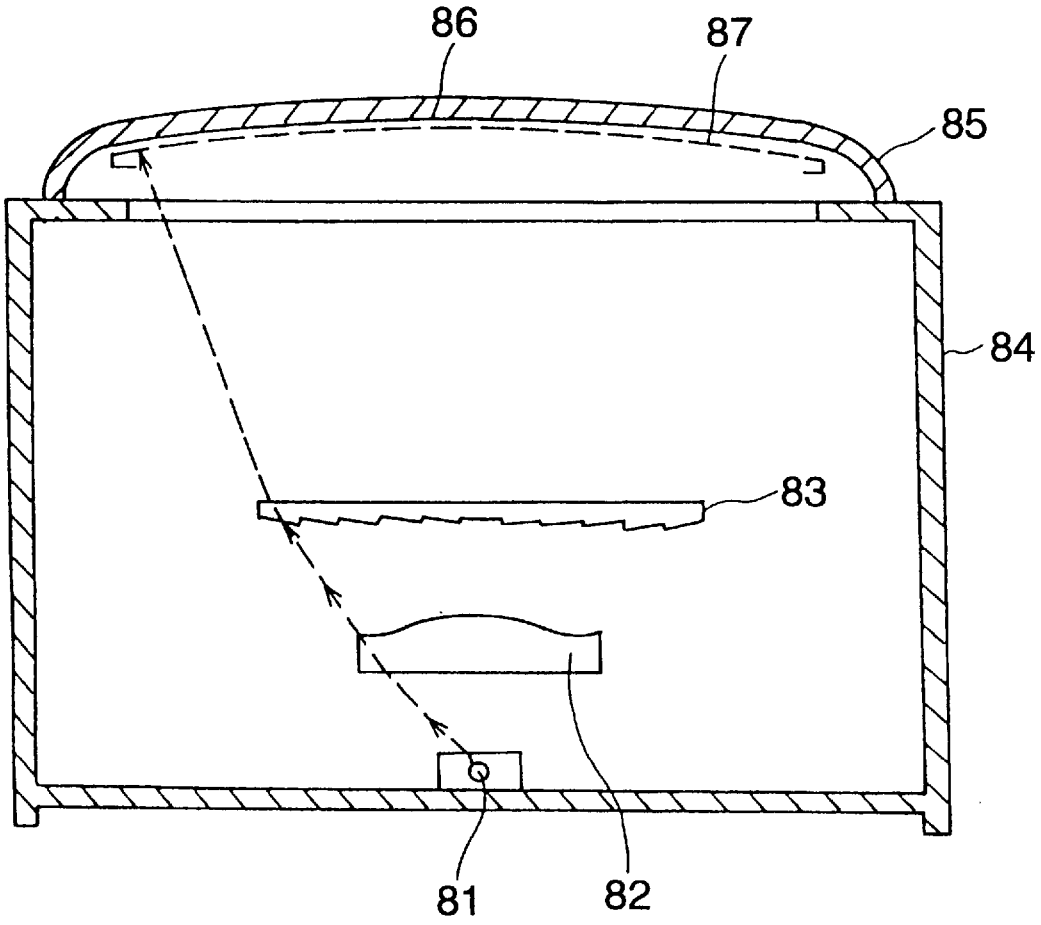
FIG. 8 is a cross-sectional view of a structure of a light exposure base.

This method for forming the dot pattern of the phosphor-material dot pattern is the same as the method explained in conjunction with FIG. 8 in the above "Description of the Related Art", in which, in the present invention, a prior art correction lens 83 in FIG. 8 is replaced by the correction lens 3 of the present invention, exposure light (shown by a dotted line) emitted from a light source 81 is transmitted through a lens 82 and the correction lens 3 to be irradiated onto a shadow mask 87. At this time, by vibrating the correction lens 3, the exposure light is uniformly irradiated onto the shadow mask 87 within a predetermined time, which results in that the exposure light passed through the shadow mask 87 is evenly irradiated on the photosensitive material film at the inner surface of the face panel of the cathode-ray tube all over the light exposure surface, with uniform distribution of the quantity of light irradiated.

When the photosensitive material film subjected to the even light exposure is used as a mask to subject the phosphor film formed under the photosensitive film layer to an etching process, a phosphor dot pattern having a good positional accuracy and a configuration accuracy is formed on the inner surface of the face panel of the cathode-ray tube.

When a color cathode-ray tube manufactured by the aforementioned method is employed, further, there can be obtained a high-resolution television set and a terminal monitor.

Explanation will next be made as to evaluation results of the face panels of the cathode-ray tubes manufactured by the above method.

Figure 21:
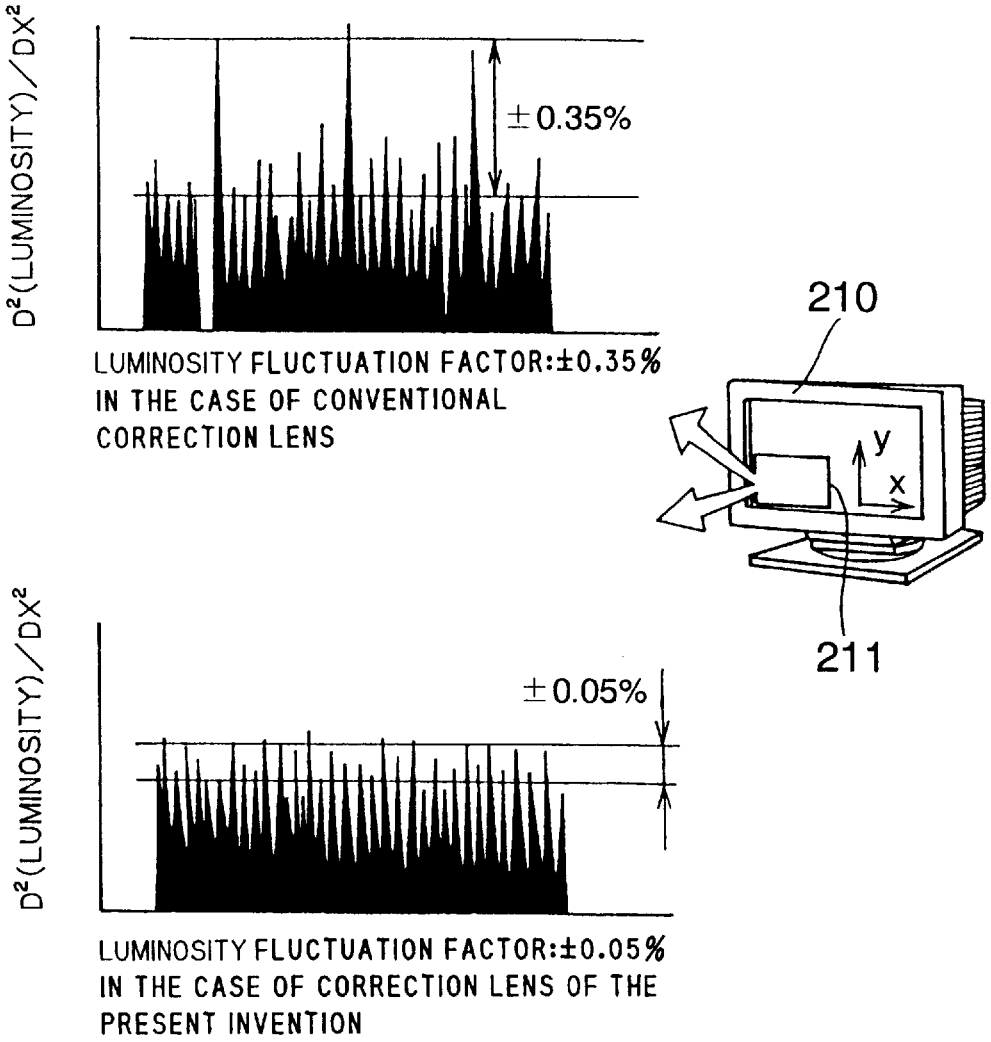
FIG. 21 shows diagrams for comparison of the light exposure effect between the correction lenses of the prior art and the embodiment 1 of the present invention.

FIG. 21 shows the light exposure effects of different correction lenses of the present invention and prior art for comparison therebetween when these correction lenses are used to form phosphor dot patterns on the inner surfaces of the face panels of respective resultant cathode-ray tubes.

The above light exposure effect comparison was carried out by evenly illuminating light onto the inner surface 86 of the face panel 85 of the cathode-ray tube having the phosphor dot pattern formed thereon from its rear side under the respective conditions, by detecting the surface of the face panel with use of a television camera installed on the front side of the face panel to obtain an image signal, and then by processing the detected image signal on a pixel basis.

The face panel 85 of the cathode-ray tube manufactured according to the above method generally tends to produce line-like luminosity irregularities in its vertical direction (corresponding to the Y direction in FIG. 21). Thus, in order to increase the processing accuracy of the image signal, a signal of pixels in the vertical direction was added to the image signal to evaluate luminosity fluctuation in the horizontal direction (corresponding to the X direction in FIG. 21).

In this case, there were used, as evaluation indexes, such a luminosity fluctuation (which is produced when luminosities at points in the X direction as added in the Y direction is differentiated twice with respect to coordinates X of the points in a predetermined range 211 of a fluorescent screen 210 of the cathode-ray tube) and a luminosity fluctuation factor as defined below.

Luminosity fluctuation=d(luminosity)/dx

Luminosity fluctuation factor=(luminosity fluctuation/y-direction projection pixel number)/(average luminosity of cathode-ray tube measurement screen)×100

In this case, the luminosity fluctuation defined above has a good correlation with the luminous line irregularities confirmed when the predetermined range 211 of the cathode-ray tube fluorescent screen 210 to be measured is visually observed. It has been experimentally found by the inventors of the present application that, in order to obtain a high-quality cathode-ray tube, its luminosity fluctuation should be made small and its luminosity fluctuation factor should be made to be ±0.15% or less.

In accordance with the present invention, the length of one side of the planar or curved faces of the surface of the correction lens for light exposure was made to be half or ⅓ or less of that of the prior art, the level difference at the boundaries of a plurality of different planar or curved faces having different tilts with respect to the reference plane was minimized so that the energy of light irradiated on the light exposure surface during the formation of the fluorescent screen pattern does not vary from place to place, the tilt direction of the side wall of each of the boundaries was set to be parallel to the optical path of incident light directed from the light source, light exposure was carried out during the vibration of the correction lens. As a result, uniform light exposure was realized throughout the entire light exposure surface, the luminosity fluctuation factor was made to be ±0.05% or less when compared with ±0.35% in the prior art correction lens, and thus the intended target of obtaining a luminosity fluctuation factor of ±0.15% or less was attained.

Shown in FIG. 21 is a typical example of the present invention. A plurality of face panels of cathode-ray tubes were prepared based on the foregoing embodiment, their luminosity fluctuations were measured and then their luminosity fluctuation factors were found. In any of the face panels, the above target of obtaining a luminosity fluctuation factor of ±0.15% or less was realized.

That is, it will be seen that, when the width of the latticed light and dark lines resulting in deteriorated light exposure effect is made small, the pattern accuracy of the fluorescent film, i.e., the positional and shape accuracies were improved, which resulted in that a high-definition cathode-ray tube was obtained.

Figure 4:
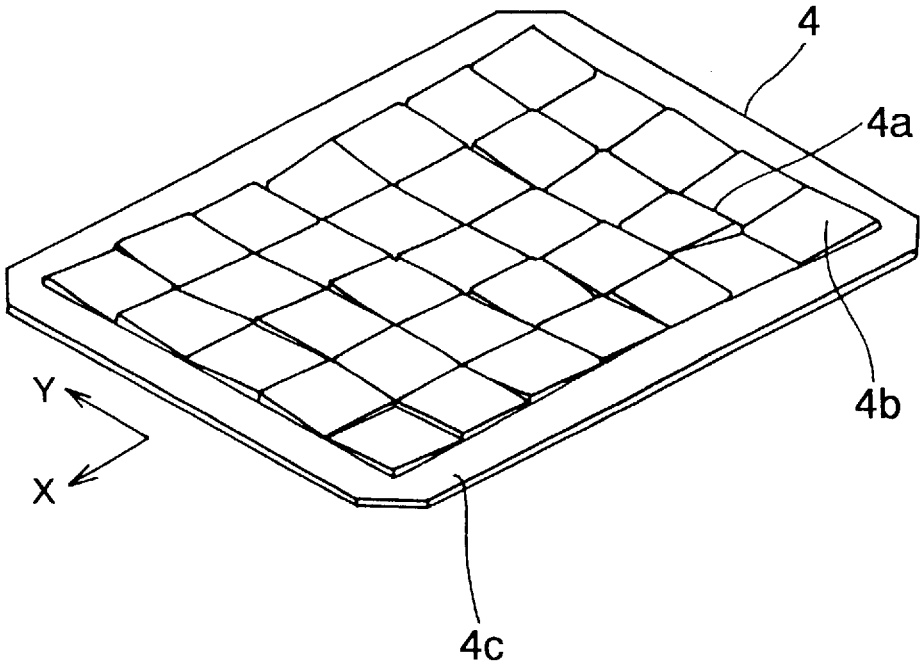
FIG. 4 is a perspective view of a correction lens in accordance with an embodiment 2 of the present invention, showing its appearance.
Figure 5:
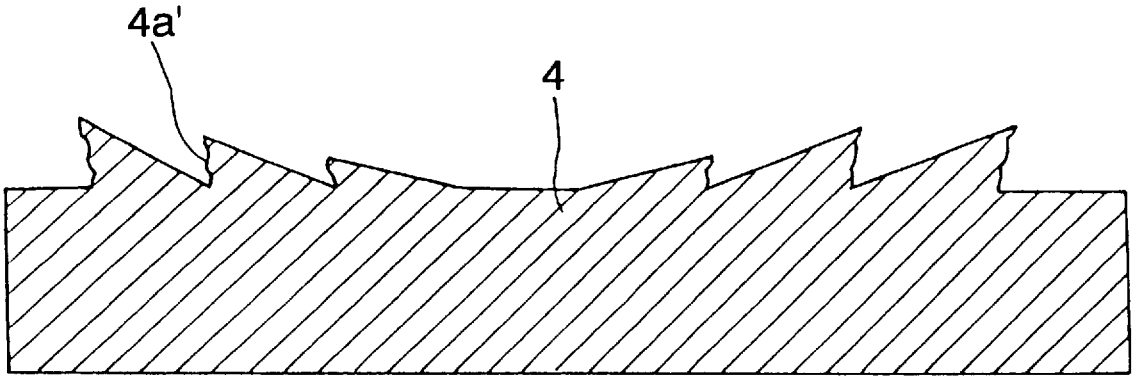
FIG. 5 is a cross-sectional view of the correction lens of the embodiment 2 of the present invention.
Figure 6:
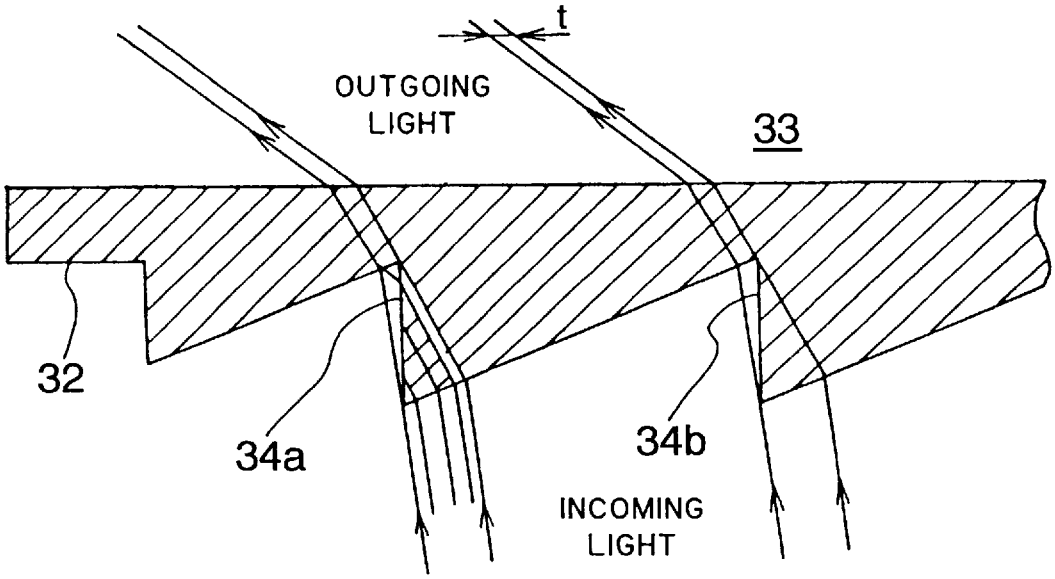
FIG. 6 is a magnified cross-sectional view of the part of the prior art correction lens.
Figure 7:
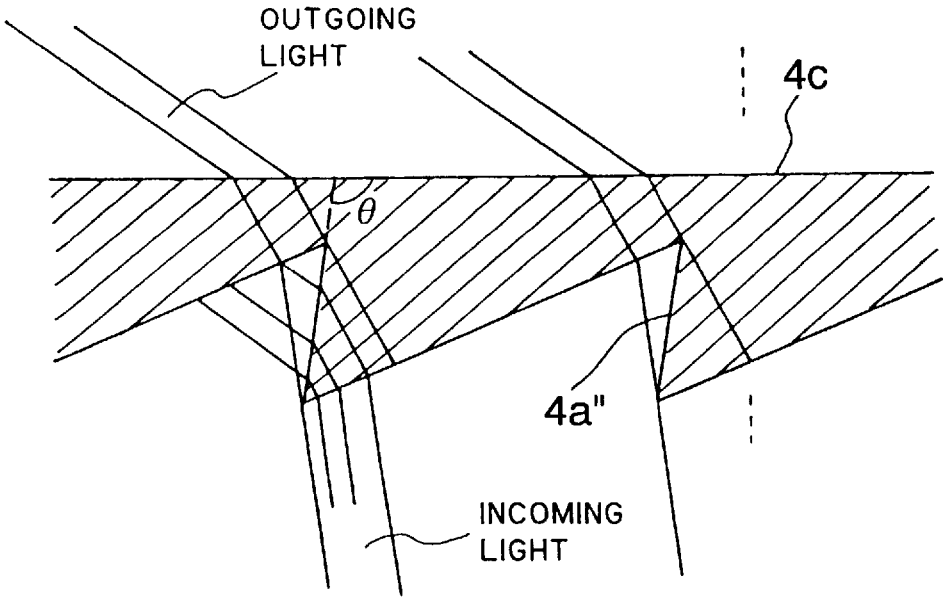
FIG. 7 is a magnified cross-sectional view of a part of the correction lens of the embodiment 2 of the present invention.

Embodiment 2:

FIG. 4 is a perspective view of an appearance of a correction lens in accordance with another embodiment of the present invention. FIG. 5 is a cross-sectional view of the correction lens of the embodiment of FIG. 4. FIG. 6 is a partially magnified cross-sectional view of a prior art correction lens. FIG. 7 is a partially magnified cross-sectional view of the embodiment of FIG. 5.

A correction lens 4, which is made of optical plastic having a high light transmissivity such as polymethyl metaacrylate, comprises a combination of a plurality of planar or curved faces 4*b* having different tilts in X and Y directions with respect to a reference plane 4*c*.

The correction lens of FIG. 4 has a shape similar to that of the correction lens manufactured by the prior art technique, but is different from the prior art correction lens in that, as shown in FIG. 7, an angle θ of a level difference face 4a" at the boundaries of the plurality of differently-tilted planar or curved faces of the correction lens with respect to the reference plane 4*c* is constant with respect to exposure light incident at an angle of 120 degrees or less. Generally speaking, it is impossible to mold a lens having such a shape when consideration is paid to the characteristics of the correction lens from a mold (releasability). In accordance with the present invention, however, since a mold is provided therein with a transfer surface having a configuration corresponding to the divided planar or curved faces of a correction lens, the height of the level difference at boundaries of regions having a plurality of planar or curved faces having different tilt angles can be made to be 5 μm or less. Thus, a correction lens made of soft optical plastic material can be molded in the mold and then be released from the mold.

In this way, when the level difference face 4*a*" is made to form an obtuse angle with reference to the reference plane, interference occurs in the exposure light directed to the region boundaries and the vicinity thereof to be dispersed over a relatively wide region, so that the energy of the exposure light exiting from the parts of the correction lens affected by the region boundaries can be reduced and therefore a latticed dark line pattern can be produced which is uniform in width and contrast.

As a means for further reducing the energy of exposure light exiting from the parts of the correction lens affected by the region boundaries, several or several tens of lines are made in a level difference surface 4*a*' of region boundaries to deteriorate the surface roughness as shown in FIG. 5. As a result, the light transmission factor at the level difference surface 4*a*' can be reduced to further decrease the quantity of exposure light exiting from the parts of the correction lens affected by the region boundaries.

Further, on the rear side of the region boundary, i.e., on the light exit side of the exposure light of the correction lens, the parts at which the exiting light is affected by the above region boundaries are formed therein with a predetermined width of lines, scratches or the like to make the face rough and to scatter the exposure light, whereby there can be complemented an irregularity in the width of the latticed dark line pattern which is major one of causes of generating variations during the molding of the dot pattern. When the rear side of the region boundary is made rough in this way, it is unnecessary to make the angle θ of the level difference surface 4*a*' or 4*a*" to be constant with respect to the incident exposure light. In other words, the angle θ may be made constant.

That is, in the case of the correction lens 4 according to the second embodiment, it is sufficient to make uniform, all over the light exposure surface, the line width and contrast of the dark line pattern generated on the exposure light surface by the exposure light passed through the correction lens 4 and reaching the exposure light surface.

Explanation will next be made as to a mold for molding of the correction lens of the present invention shown in FIG. 4.

Figure 18:
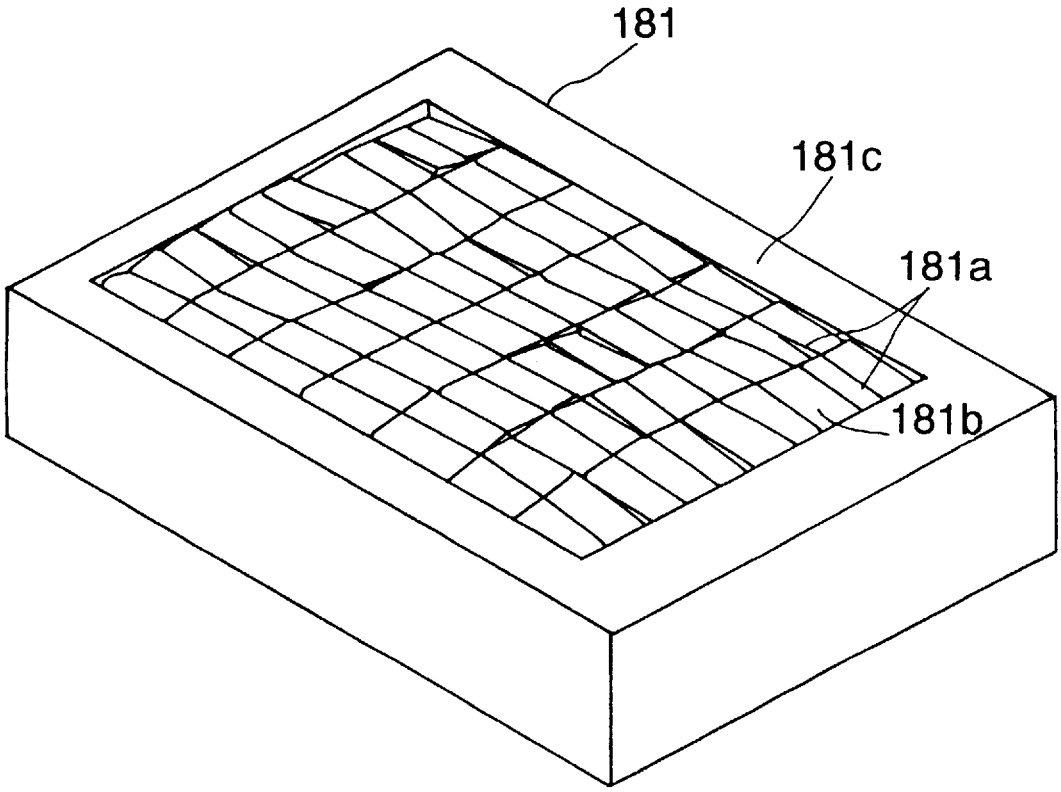
FIG. 18 is a perspective view of a mold for the correction lens in accordance with the embodiment 2 of the present invention, showing its appearance.

FIG. 18 is a perspective view of a mold for use in molding the correction lens of FIG. 4 according to the embodiment of the present invention, showing its appearance. For the material of a mold 181, non-ferrous soft metal such as, e.g., aluminum alloy, brass or copper is suitably employed from the viewpoint of its processability or machinability to be later explained. The lowermost point of a plurality of planar or curved faces 181*a* differently tilted relative to a reference bottom plane 181*c* is transferred as the uppermost point of the tilt surface of the resultant correction lens to be molded. The surface of the mold 181 is formed to correspond to the transfer surface of the correction lens shown in FIG. 1.

How to machine the above mold will be then explained.

Figure 19:
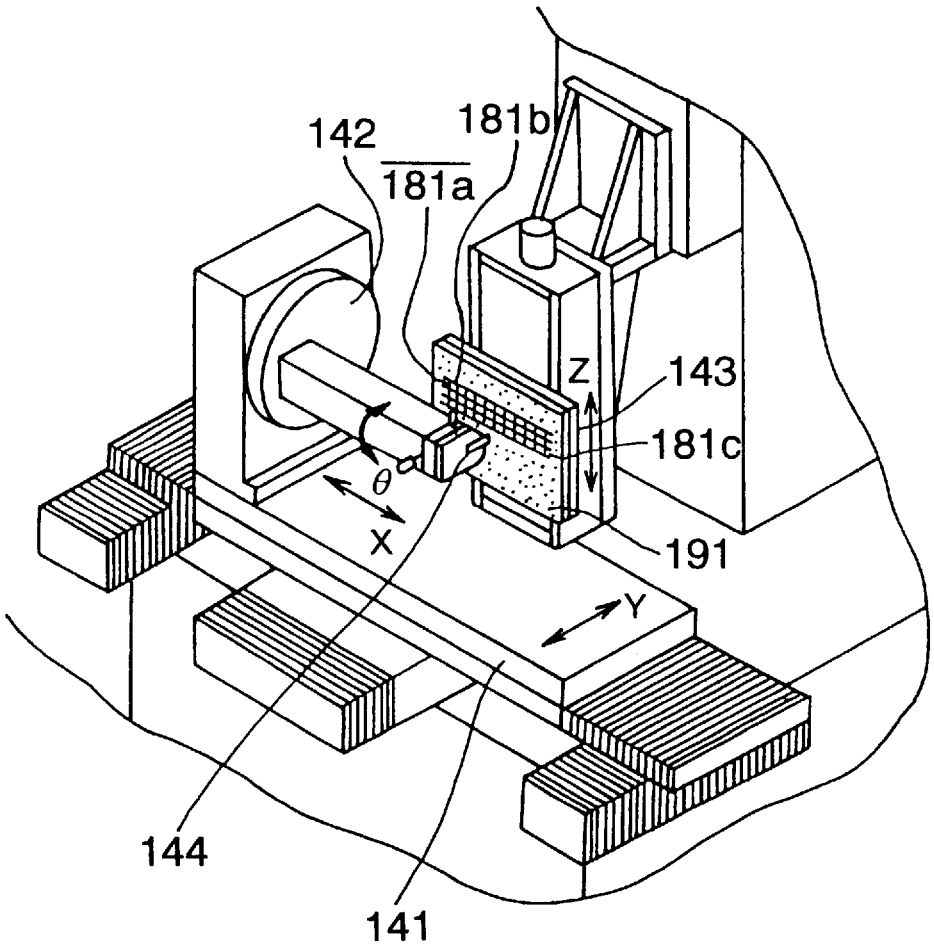
FIG. 19 is a machine for machining the mold of the correction lens in accordance with the embodiment 2 of the present invention.
Figure 20:
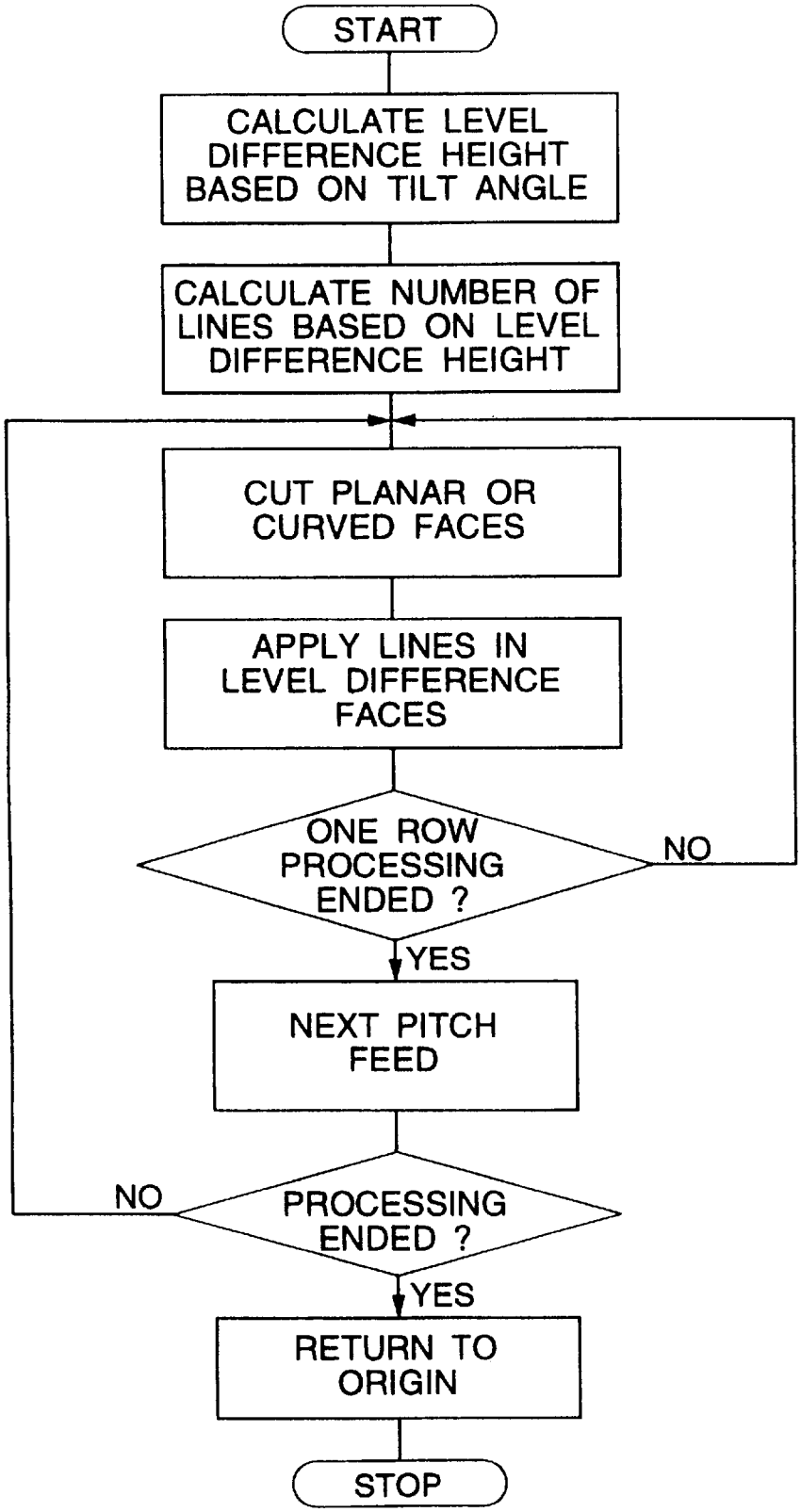
FIG. 20 is a flowchart for explaining a machining process for the mold of the correction lens in accordance with the embodiment 2 of the present invention.

FIG. 19 shows a machine for cutting into the mold for molding of the correction lens of the present invention. FIG. 20 shows a flowchart for explaining the cutting process of the mold of the present invention.

A mold 191 is fixedly mounted onto the Z table 143 for positioning of its pitch direction. One surface of the mold is cut with use of such a cutting tool as diamond tool or bit into the aforementioned transfer surface of the correction lens. The diamond cutting tool 144 is fixedly mounted to the rotary table 142 to be rotated around the center of the cutting edge of the tool at its tip end as a rotary center, so that a movement of the table 141 in the X direction with respect to the mold 181 causes a cutting while a continuous movement of the table 141 in the X direction causes a cutting feed.

Prior to carrying out the above cutting work, the angle θ with respect to the reference plane is previously calculated on the basis of the uppermost point of the region boundary of the planar or curved faces to be processed, the number of lines and an optimum machining position are determined on the basis of the height of the planar or curved face 181*a*, this cycle is sequentially repeated to determine the machining positions for the level steps of all the discontinuous boundaries, after which the mold cutting is now started actually.

When several to several tens of lines are applied to such a level difference surface 4*a*' as shown in FIG. 5 in order to deteriorate the surface roughness of the level difference surface 4*a*', cutting conditions are controlled so as to cause the cutting feed amount to vary on a desired pitch basis during the cutting operation of the planar or curved face 181*a* of the mold 181. This results in that lines of grooves and raised ridges of several μm deep are formed on the planar or curved face 181*a*.

In this cutting system, after one row of planar or curved faces have been cut, pitch feed of the Z table 143 is effected so that the attitude of the diamond cutting tool 144 is sequentially changed by the rotary table 142 during the cutting to a desired Y-directional tilt angle of a planar or curved face 181*b* to be next cut.

In this connection, the length of the cutting edge of the diamond cutting tool 144 in a direction perpendicular to the cutting direction X is previously set to be equal to or somewhat longer than one side of the desired planar or curved face 181*b*.

The mold made according to the above cutting system is supplied with optical plastic such as polymethyl metaacrylate or thermosetting resin having a high light transmissivity to one surface of the mold, and then is subjected to a heating and compressing process to thereby form a correction lens. In this connection, ultraviolet-ray setting resin may supplied to the surface of the mold and be subjected to an ultraviolet-ray irradiation to thereby form a correction lens.

In the case of the mold manufactured through the process of the aforementioned cutting system, since the size of the desired planar or curved face 181*b* and the surface configuration of the mold can be designed with a great flexibility, an accurate correction lens can be manufactured.

Explanation will next be made as to how to form a phosphor or fluorescent dot pattern by light exposing the photosensitive material film on the inner surface of the face panel of a cathode-ray tube with use of the correction lens 4 of the present invention made in accordance with the aforementioned processing method.

The method of forming the fluorescent dot pattern is the same as the method explained in the above 'Description of the Related Art' in connection with FIG. 8 as already explained even in the first embodiment. That is, in the present invention, the prior art correction lens 83 of FIG. 8 is replaced with the correction lens 4 of the present invention so that the exposure light (shown by the dotted line in the drawing) emitted from the light source 81 is passed through the lens 82 and correction lens 4 and then irradiated on the shadow mask 87. With regard to the correction lens 4, the tilt angle of the level difference or boundary face 4*a*" or 4*a*' of the region boundary with respect to the reference plane 4*c* is made to be a constant obtuse angle, the surface roughness of the boundary face is deteriorated, or a constant width of lines or scratches are applied to the rear side of the region boundary to make the surface rough and to decrease the quantity of exposure light passed through the region boundary, whereby the width and contrast of a latticed line produced by the exposure light passed through the correction lens can be made desirably constant.

When light exposure is carried out with use of the correction lens 4 thus formed, the irradiation of the exposure light during the vibration of the correction lens 4 causes the exposure light to be uniformly irradiated on the shadow mask 87 in a predetermined time, whereby the exposure light passed through the shadow mask 87 can be irradiated on the photosensitive film on the inner surface of the face panel of the cathode-ray tube all over the light exposure surface with a uniform distribution of the quantity of light energy irradiated.

As a result, a fluorescent dot pattern having good positional and configuration accuracies can be formed on the inner surface of the face panel of the cathode-ray tube.

Employment of the above color cathode-ray tube enables production of high-definition television sets and terminal monitors.

The color cathode-ray tube manufactured according to the present embodiment was subjected to light exposure effect measurements, which measurement results were substantially the same as those in the foregoing first embodiment.

Although the means for realizing the present invention has been explained in the foregoing in connection with the two embodiments, the present invention is not limited to the specific embodiments. That is, the correction lens for light exposure for formation of the fluorescent dot pattern at the inner surface of the face panel of the color cathode-ray tube according to the present invention is formed with the plurality of fine planar or curved faces so that the method disclosed in the first embodiment may be combined with the method disclosed in the second embodiment or part of these methods may be used, so long as the line width of a latticed light/dark line pattern or a dark line pattern generated on the light exposure surface when the exposure light is irradiated thereon as well as the contrast of the exposure light irradiated on these patterns and the light exposure surface other than the patterns become constant all over the light exposure surface.

For example, even when the correction lens is formed on its light entrance surface side with a configuration based on the method disclosed in the first embodiment and on the opposite light exit surface side with such a uniform width of grooved and ridge lines as disclosed in the second embodiment; the line width of the light/dark pattern or dark line pattern as well as the contrast of the exposure light irradiated on these patterns and the light exposure surface other than the patterns are made constant and uniform over the entire light exposure surface.

In accordance with the present invention, since the line width of the latticed light and dark lines generated by the correction lens having the plurality of fine planar or curved faces thereon as well as the contrast thereof can be made uniform all over the light exposure surface on the shadow mask, the light exposure during the vibration of the correction lens enables the formation of a fluorescent dot pattern having good configuration and positional accuracies, which leads to a cathode-ray tube having a good quality of display.

In addition, the use of such cathode-ray tubes enables production of high-definition television sets and terminal monitors.

We claim:

1. A display screen for a color cathode-ray tube characterized in that the display screen has a fluorescent dot pattern formed by light exposure through a shadow mask with at least 1,000,000 pixels, and the display screen has a luminosity fluctuation factor which is not greater than ±0.15%.

2. A display screen for a color cathode-ray tube as set forth in claim 1, characterized in that said fluorescent dot pattern is formed by the light exposure through said shadow mask during vibration of a correction lens having a plurality of planar or curved faces formed thereon.

3. A display screen for a color cathode-ray tube as set forth in claim 2, characterized in that a level difference of said adjacent planar or curved faces of said correction lens is set to be not greater than 5 $\mu$m, and the light exposure of said fluorescent dot pattern is carried out with use of said correction lens.

4. A display screen for a color cathode-ray tube as set forth in claim 3, characterized in that said correction lens has a surface having said level difference formed parallel to an incidence direction of said exposure light to said correction lens, and the light exposure of said fluorescent dot pattern is carried out with use of said correction lens.

5. A display screen for a color cathode-ray tube as set forth in claim 3, characterized in that said correction lens has a surface having said level difference formed tilted at an angle of 120 degrees or less with respect to a reference plane of said correction lens, and the light exposure of said fluorescent dot pattern is carried out with use of said correction lens.

6. A display screen for a color cathode-ray tube as set forth in claim 3, characterized in that said correction lens has a region having a constant width on an exit side of said exposure light and for reducing a transmissivity of said exposure light, and the light exposure of said fluorescent dot pattern is carried out with use of said correction lens.

7. A display screen for a color cathode-ray tube as set forth in claim 3, characterized in that said correction lens has a surface having said level difference of fine recessed and raised portions tilted at an angle of 120 degrees or less with respect to a reference plane of said correction lens, and the light exposure of said fluorescent dot pattern is carried out with use of said correction lens.

8. A display screen for a color cathode-ray tube as set forth in any of claims 2 to 7, characterized in that said correction lens is made of an optical plastic material molded by an integral mold, and the light exposure of said fluorescent dot pattern is carried out with use of said correction lens.

9. A display screen for a color cathode-ray tube as set forth in claim 1, wherein the color cathode-ray tube has the display screen forming a front portion of a display tube, the display tube including an electron gun for generating an electron beam for impinging on the fluorescent dot pattern of the display screen, and a deflection yoke being provided with respect to the display tube for controlling the electron beam generated by the electron gun.

10. A method for manufacturing a display screen for a color cathode-ray tube, characterized in that a correction lens is formed with a plurality of adjacent planar or curved faces, level differences between the adjacent planar or curved faces are set to be not greater than 55 $\mu$m, exposure light passed through said correction lens during vibration of the correction lens is irradiated through a shadow mask on a photosensitive film on an inner surface of a face panel for a color cathode-ray tube for light exposure thereof to form a fluorescent dot pattern on the face panel with the light-exposed photosensitive film used as a mask, whereby the face panel forms at least part of the display screen for the color cathode-ray tube and the display screen is made of said fluorescent dot pattern having at least 1,000,000 pixels and having a luminosity fluctuation factor which is not greater than ±0.15%.

11. A method as set forth in claim 10, characterized in that said correction lens has a surface having said level difference formed parallel to an incidence direction of said exposure light to said correction lens, and the light exposure of said fluorescent film is carried out with use of said correction lens.

12. A method as set forth in claim 10, characterized in that said correction lens has a surface having said level difference formed tilted at an angle of 120 degrees or less with respect to a reference plane of said correction lens, and the light exposure of said fluorescent film is carried out with use of said correction lens.

13. A method as set forth in claim 10, characterized in that said correction lens has a region having a constant width on an exit side of said exposure light and for reducing a transmissivity of said exposure light, and the light exposure of said fluorescent film is carried out with use of said correction lens.

14. A method as set forth in claim 10, characterized in that said correction lens has a surface having said level difference of fine recessed and raised portions tilted at an angle of 120 degrees or less with respect to a reference plane of said correction lens, and the light exposure of said fluorescent film is carried out with use of said correction lens.

15. A method as set forth in any of claims 10 to 14, characterized in that said correction lens is made of an optical plastic material molded by an integral mold, and the light exposure of said fluorescent film is carried out with use of said correction lens.

16. A method for manufacturing a display screen for a color cathode-ray tube, characterized in that a correction lens is provided with a plurality of planar or curved faces, exposure light is irradiated on said correction lens during vibration of the correction lens to cause uniform generation of a width of a latticed light/dark line or dark line pattern produced by the planar or curved faces during light exposure and a contrast thereof all over an light exposure surface, said exposure light passed through the correction lens is irradiated on a shadow mask positioned at a front of a face panel for said color cathode-ray tube, said exposure light passed through the shadow mask is directed to a fluorescent film on said face panel for light exposure to form a fluorescent dot pattern on said face panel which form at least part of the display screen for the color cathode-ray tube, said display screen being made of said fluorescent dot pattern with at least 1,000,000 pixels, and said display screen having a luminosity fluctuation factor which is not greater than ±0.15%.

17. A method as set forth in claim 16, characterized in that said correction lens has a surface having said level difference formed parallel to an incidence direction of said exposure light to said correction lens, and the light exposure of said fluorescent film is carried out with use of said correction lens.

18. A method as set forth in claim 16, characterized in that said correction lens has a surface having said level difference formed tilted at an angle of 120 degrees or less with respect to a reference plane of said correction lens, and the light exposure of said fluorescent film is carried out with use of said correction lens.

19. A method as set forth in claim 16, characterized in that said correction lens has a region having a constant width on an exit side of said exposure light and for reducing a transmissivity of said exposure light, and the light exposure of said fluorescent film is carried out with use of said correction lens.

20. A method as set forth in claim 16, characterized in that said correction lens has a surface having said level difference of fine recessed and raised portions tilted at an angle of 120 degrees or less with respect to a reference plane of said correction lens, and the light exposure of said fluorescent film is carried out with use of said correction lens.

21. A method as set forth in any of claims 16 to 20, characterized in that said correction lens is made of an optical plastic material molded by an integral mold, and the light exposure of said fluorescent film is carried out with use of said correction lens.

22. A method for manufacturing a display screen for a color cathode-ray tube comprising the steps of:

uniformly generating a width of a latticed light/dark line or dark line pattern produced by planar or curved faces during light exposure of a correction lens provided with a plurality of planar or curved faces and provided with a surface having a level difference formed parallel to an incidence direction of an exposure light; and irradiating the exposure light on a shadow mask positioned at a front of a face panel for the cathode-ray tube during vibration of the correction lens so that the exposure light which passed through the shadow mask is directed to a fluorescent film on the face panel for light exposure to form a fluorescent dot pattern on the face panel forming at least part of the display screen for the color cathode-ray tube, the display screen being made up of the fluorescent dot pattern having at least 1,000,000 pixels, and the display screen having a luminosity fluctuation factor which is not greater than ±0.15%.

23. A method as set forth in claim 22, characterized in that said correction lens has a surface having said level difference formed tilted at an angle of 120 degrees or less with respect to a reference plane of said correction lens, and the light exposure of said fluorescent film is carried out with use of said correction lens.

24. A method as set forth in claim 22, characterized in that said correction lens has a region having a constant width on an exit side of said exposure light and for reducing a transmissivity of said exposure light, and the light exposure of said fluorescent film is carried out with use of said correction lens.

25. A method as set forth in claim 21, characterized in that said correction lens has a surface having said level difference of fine recessed and raised portions tilted at an angle of 120 degrees or less with respect to a reference plane of said correction lens, and the light exposure of said fluorescent film is carried out with use of said correction lens.

26. A method as set forth in any of claims 22 to 25, characterized in that said correction lens is made of an optical plastic material molded by integral mold, and the light exposure of said fluorescent film is carried out with use of said correction lens.

* * * * *